US009903540B2

(12) United States Patent
Wassel

(10) Patent No.: US 9,903,540 B2
(45) Date of Patent: Feb. 27, 2018

(54) LED LIGHT EMITTING APPARATUS HAVING BOTH REFLECTED AND DIFFUSED SUBASSEMBLIES

(71) Applicant: Appalachian Lighting Systems, Inc., Ellwood City, PA (US)

(72) Inventor: James J. Wassel, Fombell, PA (US)

(73) Assignee: Appalachian Lighting Systems, Inc., Ellwood City, PA (US)

( * ) Notice: Subject to any disclaimer, the term of this patent is extended or adjusted under 35 U.S.C. 154(b) by 0 days.

(21) Appl. No.: 14/616,420

(22) Filed: Feb. 6, 2015

(65) Prior Publication Data

US 2015/0219287 A1 Aug. 6, 2015

Related U.S. Application Data

(60) Provisional application No. 61/936,586, filed on Feb. 6, 2014.

(51) Int. Cl.

| | |
|---|---|
| ***F21K 9/68*** | (2016.01) |
| ***F21K 99/00*** | (2016.01) |
| ***F21K 9/60*** | (2016.01) |
| *F21V 29/70* | (2015.01) |
| *F21V 7/00* | (2006.01) |
| *F21V 7/04* | (2006.01) |
| *F21Y 113/00* | (2016.01) |
| *F21Y 103/10* | (2016.01) |
| *F21Y 115/10* | (2016.01) |
| *F21K 9/69* | (2016.01) |

(52) U.S. Cl.

CPC ..... *F21K 9/50* (2013.01); *F21K 9/60* (2016.08); *F21K 9/68* (2016.08); *F21K 9/69* (2016.08); *F21V 7/005* (2013.01); *F21V 7/0008* (2013.01); *F21V 7/048* (2013.01); *F21V 29/70* (2015.01); *F21Y 2103/10* (2016.08); *F21Y 2113/00* (2013.01); *F21Y 2115/10* (2016.08)

(58) Field of Classification Search

CPC ... F21K 9/50; F21K 9/30; F21V 29/70; F21V 7/005; F21V 7/048; F21V 7/0008; F21Y 2101/02; F21Y 2103/003; F21Y 2113/00

See application file for complete search history.

(56) References Cited

U.S. PATENT DOCUMENTS

| | | | | |
|---|---|---|---|---|
| 5,964,051 | A * | 10/1999 | Loeber | G09F 13/04 362/249.03 |
| 8,956,013 | B1 * | 2/2015 | Shew | F21S 9/022 362/183 |
| 9,395,052 | B1 * | 7/2016 | Shew | F21K 9/27 |
| 2003/0174517 | A1 * | 9/2003 | Kiraly | F21V 29/004 362/555 |
| 2004/0107615 | A1 * | 6/2004 | Pare | G09F 13/22 40/544 |

(Continued)

*Primary Examiner* — Anh Mai
*Assistant Examiner* — Fatima Farokhrooz
(74) *Attorney, Agent, or Firm* — Arent Fox LLP

(57) ABSTRACT

A light emitting apparatus and lighting fixture including a plurality of light emitting sub assemblies, each sub assembly comprising a plurality of LEDs. At least one light emitting subassembly comprises a diffuser positioned in front of a light emitting side of the LEDs on the subassembly. At least one of the other light emitting subassembly comprises a reflector reflecting light emitted from the LEDs.

19 Claims, 14 Drawing Sheets

(56) References Cited

U.S. PATENT DOCUMENTS

| | | | | |
|---|---|---|---|---|
| 2005/0184951 | A1* | 8/2005 | Kim | G02F 1/133604 345/102 |
| 2007/0247847 | A1* | 10/2007 | Villard | F21K 9/00 362/249.01 |
| 2009/0323334 | A1* | 12/2009 | Roberts | F21S 4/008 362/247 |
| 2010/0008085 | A1* | 1/2010 | Ivey | F21K 9/00 362/218 |
| 2010/0165620 | A1* | 7/2010 | Marson | F21V 5/007 362/235 |
| 2012/0127395 | A1* | 5/2012 | Yokota | G02F 1/133603 349/61 |
| 2014/0225514 | A1* | 8/2014 | Pickard | H05B 33/0857 315/152 |
| 2014/0268727 | A1* | 9/2014 | Amrine, Jr. | F21K 9/17 362/224 |
| 2014/0293595 | A1* | 10/2014 | May | F21S 8/04 362/218 |
| 2015/0009681 | A1* | 1/2015 | Takase | G02F 1/133603 362/308 |
| 2015/0042891 | A1* | 2/2015 | Shimizu | G02F 1/133603 348/725 |

* cited by examiner

LED LIGHT EMITTING APPARATUS HAVING BOTH REFLECTED AND DIFFUSED SUBASSEMBLIES

CROSS-REFERENCE TO RELATED APPLICATION

This application claims the benefit of U.S. Application Ser. No. 61/936,586 entitled "LED LIGHT EMITTING APPARATUS HAVING BOTH REFLECTED AND DIFFUSED SUBASSEMBLIES" and filed on Feb. 6, 2014, which is expressly incorporated by reference herein in its entirety.

BACKGROUND

Field of the Application

Aspects of the present invention relate to a light emitting diode (LED) or other solid state light emitter light devices.

Description of the Related Art

The use of incandescent, fluorescent, High Intensity Discharge (HID) and halogen bulbs has been problematic in a number of ways. First, incandescent light bulbs are very energy-inefficient and require significant maintenance. A large percentage of the energy they consume is released as heat, rather than light. Although fluorescent bulbs are more efficient than incandescent light bulbs, they are still very inefficient when compared to light emitting diodes (LEDs) or other similar solid state light emitters. Such incandescent and fluorescent light bulbs are energy-inefficient, have shorter lifetimes and incur unwanted heat and high maintenance costs when compared to solid state light emitters. A short lifetime becomes even more problematic when used in overhead lighting in large buildings with high traffic and/or material movement or in other areas where access may be difficult, such as ceiling areas with lower area obstructions, and other hard to reach areas. Bulb replacement is not only time consuming and costly, but can be dangerous.

Large commercial or industrial buildings, e.g., with ceilings of 25' height or more, often use metal halide lighting, which can produce an undesirable amount of heat and adverse impact to HVAC. Additional issues with these light fixtures is that they can periodically explode, sometimes dangerously emitting glass shards overhead of workers or others. Even when these facilities utilize T5 or T8 fluorescent lighting, they can experience very high maintenance and bulb disposal costs. These types of traditional lights also see much higher levels of lumen depreciation over time as compared to properly engineered LED lighting, and as a result, unless aggressive maintenance programs are utilized, lighting space can generally experience inadequate lower and upper area lighting conditions.

SUMMARY

Aspects of the present invention overcome the above identified problems, as well as others, by providing an LED or other solid state light apparatus (herein after also interchangeably referred to as an "LED device") that produces useful light at a distance while at the same time providing light in the area surrounding the apparatus. The light emitting apparatus directs enough light from a plurality of LEDs to a distant area in a form that provides an acceptable amount of horizontal and vertical foot candles both at a ground level, upper levels, and above the fixture.

Aspects include a design that combines a subassembly having a diffuser and another subassembly having a reflector in order to provide light to multiple horizontal and vertical levels in a large building or large area setting, such as a warehouse or box store. Aspects further include providing a customer desired visual impact that other LED lights are not able to accomplish. Additional aspects may include an uplight module that illuminates the area above the light fixture.

Additional advantages and novel features of aspects of the present invention will be set forth in part in the description that follows, and in part will become more apparent to those skilled in the art upon examination of the following or upon learning by practice thereof.

DETAILED DESCRIPTION

Figure 1A:
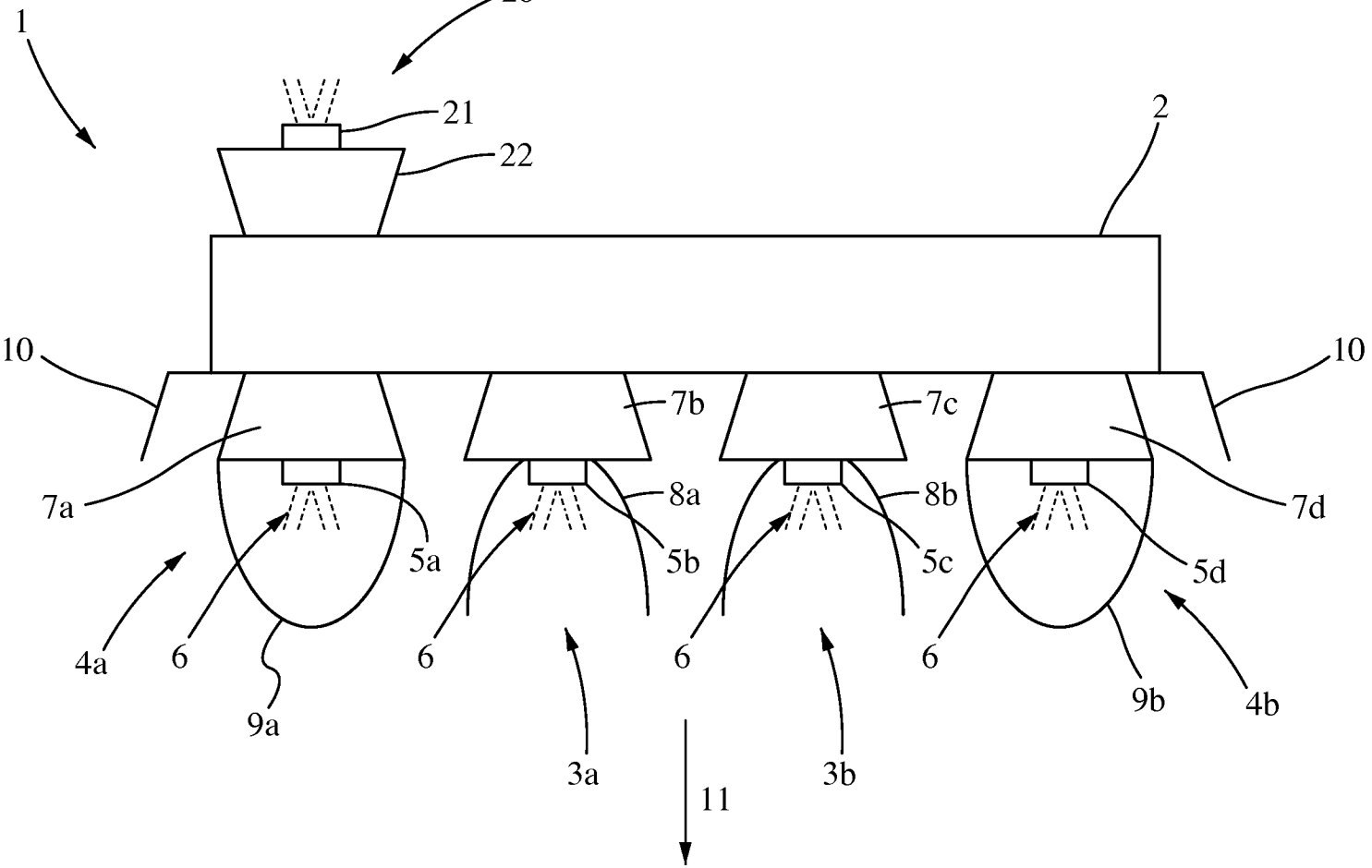
FIGS. 1A and 1B show a side view of an example light emitting apparatus having aspects in accordance with the present invention.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

Aspects present herein include an LED or other solid state emitter light device or Plasma Emitters capable of providing useful light directed to a desired area. The apparatus is referred to interchangeably herein as an LED light fixture or luminaire.

Although solid state emitters, such as LEDs, are known to be more energy efficient in general, LEDs have not been considered an option in the past for certain applications, e.g., large buildings such as warehouse or box type stores, because they do not provide light that can be seen from a distance from any angle and in a manner that extends from the area surrounding the light fixture to the ground, or above the light into the ceiling area. The result of this can create a visual impression that even though adequate light may be directed to lower horizontal area surfaces, because of the lack of vertical surface area coverage and upper ceiling surface area lumen coverage, the overall interior area can seem to have a dark look. Box stores, or other retailers for instance, want an area to look bright and vibrant from the floor to the ceiling, and want to maximize the vertical foot candles being projected adequately onto all surfaces, including aisles and high racking areas. Because of the limited downward directionality of light emitted from LED luminaires, achieving this level of luminance can be quite problematic.

When LED light is directed from the luminaire in order to provide a sufficient amount of light at the ground level surface or other lower working surface areas in a large building, this can still incur problems because racks and other vertical surfaces at a height closer to the ceiling are not illuminated to a sufficient level. For example, in a warehouse having racks extending from the floor to a height near a ceiling, light that is directed to the area near the floor will leave the upper levels of the racks generally dark or not illuminated to certain specified levels. This lack of illumination can be especially problematic when customers attempt to view items stored on the upper levels of the racks or workers try to do restocking from those levels to the lower levels. The additional separate lighting that may be required to light upper areas have tended to require higher levels of energy usage and as a result have made the ROI's for such LED lighting investment unviable.

Additionally, traditional lights with bulbs and certain design modifications to their luminaire housing can emit light in a manner that bathes the ceiling and areas near the fixture in light. This provides an aesthetically pleasing effect that brightens the entire interior of the building. The bright illumination of the building can be ascertained from any angle and even from a distance. This manner of illumination enables a store to attract passing customers who can determine that the store is open for business because of visually seeing light being emitted from the luminaires from a distance, being able to see the upper ceiling areas well lit, seeing well lit vertical surfaces, and overall seeing the overall bright interior of the building.

LED lights that direct light to the floor or lower areas, e.g., using reflectors or other optics, with the LEDs being embedded up inside the luminaire, and in which the emitted light cannot be detected from a distance at or close to a horizontal plane, or in which there is no discernible uplight capability, will tend to leave the area surrounding the light fixture looking dark. This provides an effect that causes the upper area of a building to appear dark even when the lights are turned on. This can even give the impression to potential customers that the building is closed because it appears dimmer from a distance when compared to other traditional lighting. This is a primary reason why most box stores, other retail stores, and other commercial and industrial facilities have been slow in adopting LED lighting technology for most of their lighting space.

Figure 1B:
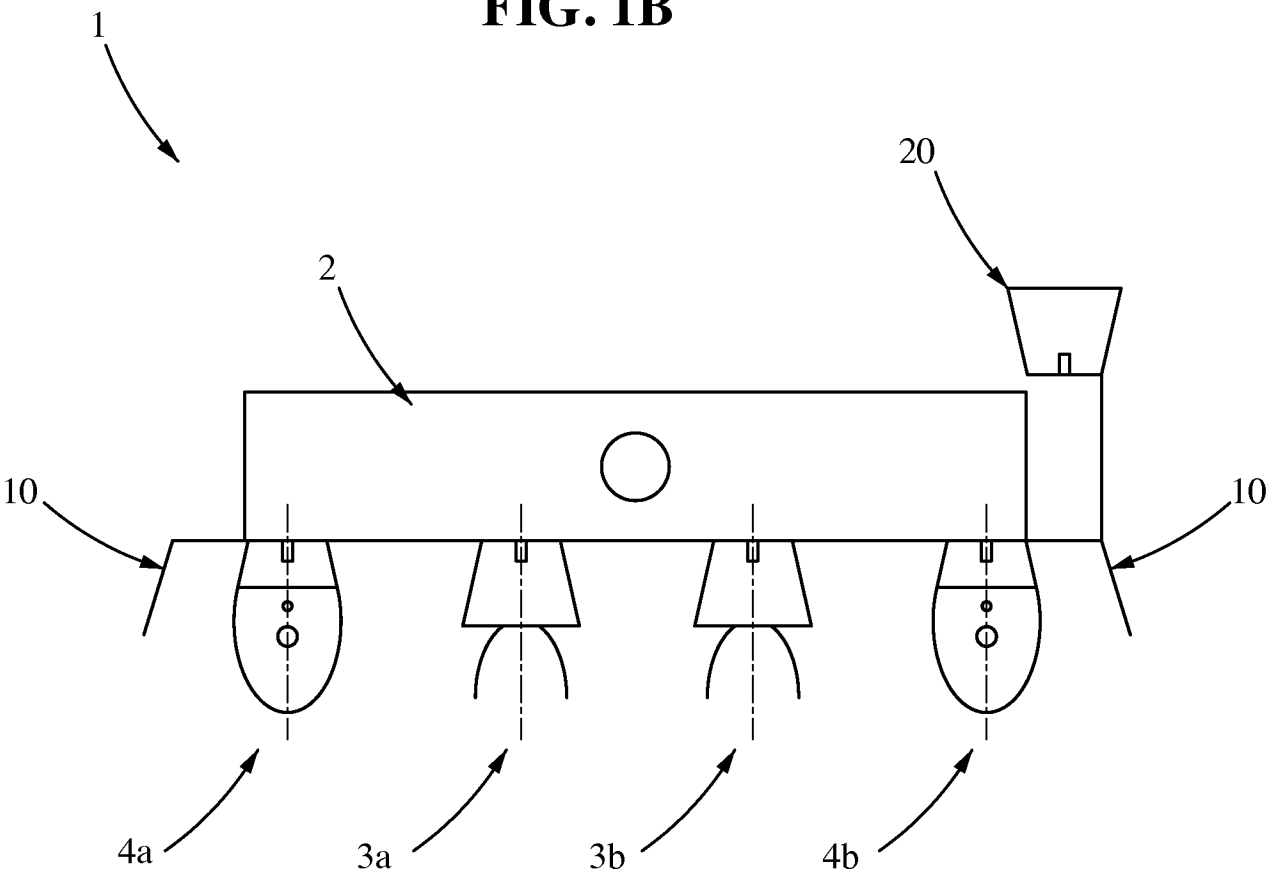

FIGS. 1A and 1B illustrate aspects of an example light emitting apparatus 1 shown from a side view. The apparatus may comprise a housing 2. The housing may comprise, among other materials, a metal material, or a plastic, etc. For example the housing may be built using aluminum, steel, plastic, and/or a combination of such materials. Although aspects may include the provisional of an aluminum housing in order to assist in the transfer of heat from the LEDs incorporated in the light emitting apparatus, the apparatus 1 may include a heat extrusion component, e.g., 7, that provides very efficient heat dissipation. As such, the housing does not need to be aluminum. The ability to use a different material for the housing allows a reduction in the cost of manufacturing the shell. This cost reduction allows the light emitting apparatus to be made available at a lower cost to customers.

The apparatus 1 comprises a plurality of light emitting sub assemblies, e.g., 3*a*, 3*b*, 4*a*, and 4*b* coupled to the housing. Each of the sub assemblies comprises at least one lighting strip 5*a*, 5*b*, 5*c*, and 5*d* having a plurality of LEDs. The LEDs may be provided in a linear strip, or in multiple sections of LED strips that may be used for each subassembly. For example, each subassembly may extend approximately four feet and comprise four—1 foot LED strips connected together on each 4 foot subassembly. A thermal pad may be positioned between the LED strips 5*a-d* and the mounting component (also referred to interchangeably herein as the "extrusion") 7*a-d* for maximum heat transfer. The LEDs are illustrated as emitting light 6 in a direction opposite the housing 2. The subassemblies 3*a*, 3*b*, 4*a*, and 4*b* also each comprise a mounting component 7*a*, 7*b*, 7*c*, and 7*d* that couples the corresponding lighting strip 5*a*, 5*b*, 5*c*, and 5*d* to the housing 2. The mounting component may be configured to function as a heat sink that extrudes heat from the area surrounding the LEDs and dissipates the heat. The heat sink aspects of the mounting component are described in additional detail infra.

In one aspect, LED lighting strips 5*a*, 5*b*, 5*c*, 5*d*, and 21 and mounting components 7*a*, 7*b*, 7*c*, 7*d*, and 22 may be modular components that can be used interchangeably. This simplifies both manufacturing and repair of the apparatus. Each subassembly may comprise a plurality of LED strips. In one example, each strip may comprise 18 LEDs, or as many as 24 LEDS, with four strips coupled to each subassembly to provide 72, or as many as 96 LEDs per subassembly. Each LED light strip comprises a plurality of LEDs, e.g., surface mounted LEDs. The LED light strips may be coupled in a daisy chain arrangement along the length of the subassembly. The lighting strips may be constructed from any suitable material for mounting LEDs and associated circuitry. The LEDs may comprise different chips from various LED chip manufacturers.

The uplight may comprise a smaller number of LED strips, e.g., only one or two. The apparatus may provide an operating range of between 0 to approximately 150 watts at approximately 4000 to 5000 Kelvin. Aspects presented herein enable a TM-21 lifetime in excess of 150,000 hours for the light fixture. The long lifetime greatly minimizes maintenance requirements as compared to traditional lighting.

The apparatus may comprise a combination of at least two different types of light emitting subassemblies. A first type of subassembly may direct LED light to a specific horizontal surface area under the light. For example, when the apparatus is mounted to the ceiling of a large area, the light may be directed toward the ground, an aisle area, a work area, etc. This subassembly type may comprise at least one reflector 8*a*, 8*b*. The reflector directs light from the LEDs toward a specific light emitting direction 11 opposite the housing 2. Aspects of the reflector are described in additional detail infra.

Figure 9:
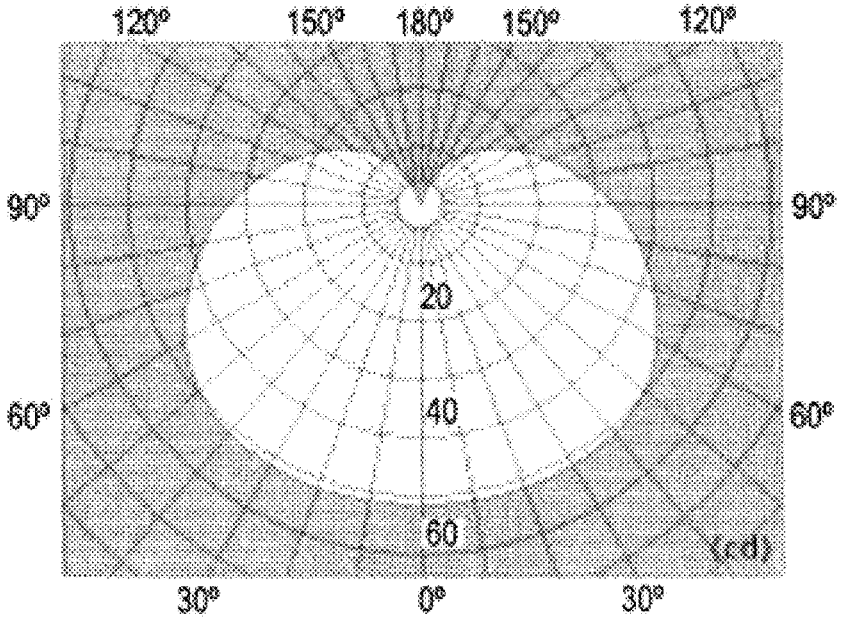
FIG. 9 shows a polar diagram illustrating aspects in accordance with the present invention.

The second type of subassembly may will be configured to bathe the area surrounding the light fixture, e.g., in a side to side manner to maximize vertical foot candle surfaces, and as example in FIG. 9 shows with the polar diagram, to an angle of as much as 150 degrees from the 90 degree horizontal plane of the fixture with illumination. This allows light to be visible to the observer from almost any angle at a distance to as high as, e.g. approximately 150 degrees. The second type of subassembly comprises a light diffuser 9*a*, 9*b*, e.g., a high efficiency light diffuser, that diffuses the light emitted from the LED light strips 5*a*, 5*d*.

By using a combination of reflector type subassemblies and separate diffuser type subassemblies in a single solid state light emitting apparatus, the apparatus maximizes both horizontal surface and vertical foot candles. The apparatus is designed to also visually show the emission of light from various viewing angles, either up close or at virtually any viewing angle at a distance within a facility.

The apparatus may be used for lighting in large warehouses, other industrial and commercial facilities, and box stores with diverse racking of various heights and aisles widths, and other similar applications. For instance, the apparatus will specifically optimize horizontal and vertical foot candles in aisle lighting by directing lumens from the reflectors to the floor and lower racking areas, and providing adequate vertical surface foot candles from the diffusers to the upper racking areas, and in a manner that provides a pleasant visual effect for potential customers or workers.

The housing 2 may further comprise side portions that provide shielding for the apparatus. The side portions may function both to shield the subassemblies from external conditions as well as to shield at least a portion of the light emitting from the uncovered LEDs 5*b*, 5*c*. The diffuser may be positioned in an exposed manner so that it extends beyond the length of the side portions. The diffuser 9*a*, 9*b* already shields the light that is emitted from lighting strips 5*a* and 5*d*. By positioning the diffuser so that it extends beyond the side portion 10 enables diffused light from lighting strips 5*a* and 5*d* to bathe the area surrounding the apparatus, and allows light being emitted from the apparatus to be viewed from virtually any angle within the facility. For example, in a ceiling mounted light fixture, this diffused light would also bathe the area up near the ceiling with light.

This combination of reflected and diffused light enables a sufficient amount of light to be directed to a distant area, such as the floor, while at the same time bathing the area closer to the ceiling with diffused light. This creates a pleasing effect similar to other lighting sources (as described in section 0002) in a much more energy efficient manner.

In FIGS. 1A and 1B, the apparatus 1 includes two reflector type subassemblies 3*a*, 3*b* disposed between two diffuser type subassemblies 4*a*, 4*b*. The subassemblies on the outside edge are referred to interchangeably herein as outboard subassemblies. The subassemblies positioned inside the outboard subassemblies are referred to interchangeably herein as inboard subassemblies.

Although four subassemblies are illustrated, other combinations may be provided. For example, a single reflector type subassembly may be provided between two diffuser type subassemblies. Alternatively, three or more inboard reflector type subassemblies may be provided on the apparatus. Even when additional reflector type subassemblies are included, it may be beneficial to position the reflector type subassemblies between diffuser type subassemblies, because it enhances shielding the bright light from the reflector type subassemblies, thus allowing light to be directed specifically down beneath the luminaire to maximize the horizontal surface foot candles. At times, it may be desirable to provide only a single reflective type subassembly and/or a single diffuser type subassembly. Although the diffuser type subassemblies provide additional side shielding of direct light emitted from the LEDs of other subassemblies, at times it might be desirable to position the diffuser type subassemblies in a different manner.

As an additional option, an uplight module 20 may be provided on a side of the housing opposite the light emitting subassemblies 3*a*, 3*b*, 4*a*, 4*b*. The uplight may comprise, e.g., a lighting strip 21 having a single or plurality of LEDs, which may be coupled to a side of housing 2 opposite the light emitting direction 11 via a mounting component 22. Mounting component 22 may function as a heat sink, similar to mounting components 7*a*, 7*b*, 7*c*, and 7*d*. Although the uplight module is illustrated at a side position, this component may be provided at the opposite side, e.g., near a position opposite subassembly 4*b*. Alternatively the uplight module 20 may be provided in a more central location. More than one uplight module may be included in the light emitting apparatus 1. The number and position of the uplight module may be selected based on the amount of light desired above the apparatus and the distance from the ceiling at which the apparatus will be placed. Aspects of an uplight module are described in more detail infra.

Figure 2:
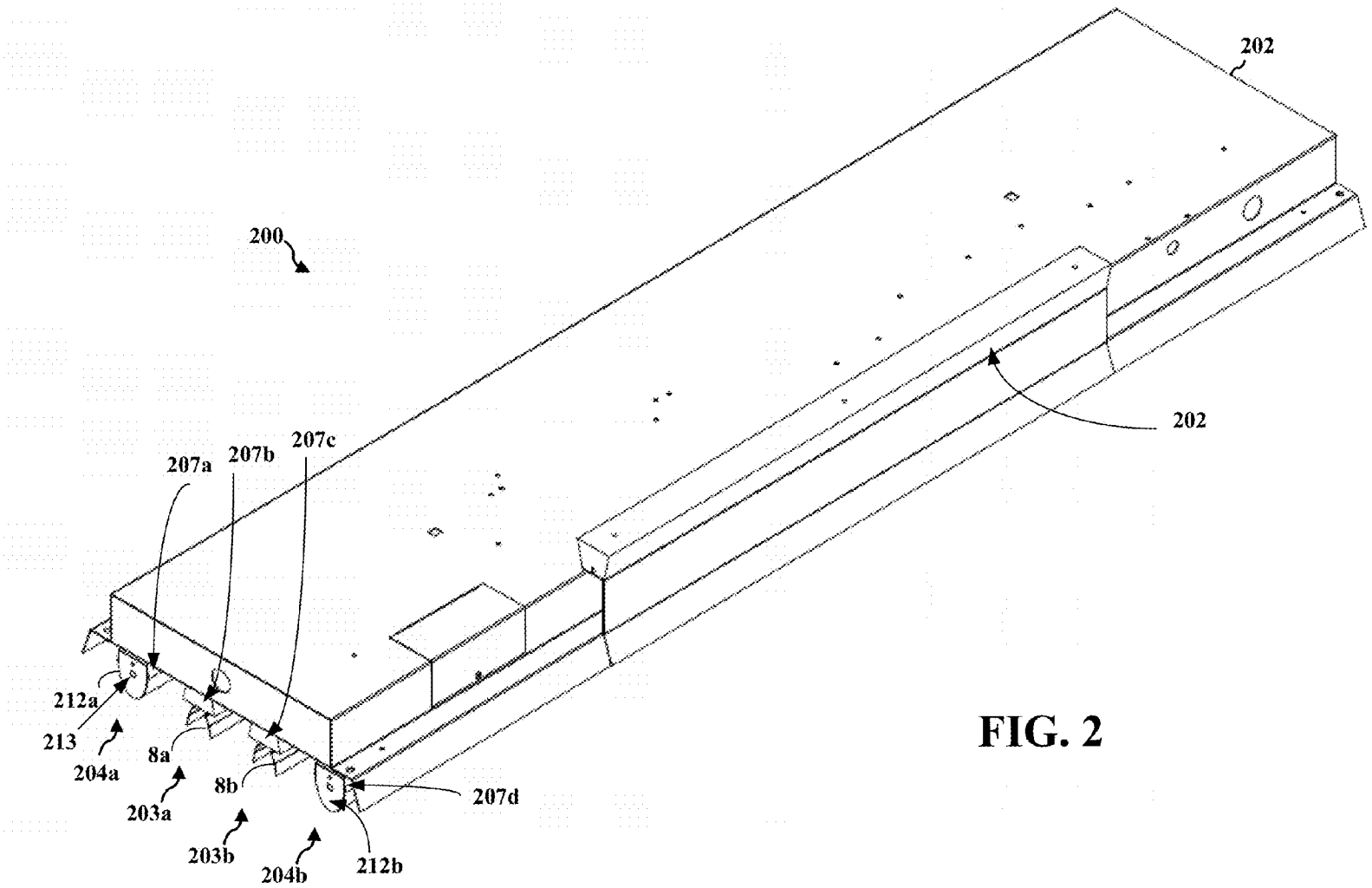
FIG. 2 shows an upper view of an example light emitting apparatus having aspects in accordance with the present invention.

FIG. 2 illustrates a view of an example solid state light emitting apparatus 200 having a combination of reflected light emitting subassemblies 203*a*, 203*b* and diffused light emitting subassemblies 204*a*, 204*b* coupled to a housing 202 via mounting components/heat sinks 207*a*, 207*b*, 207*c*, 207*d*. The apparatus includes an uplighting subassembly 220, including a mounting substrate 227 for mounting an LED strip as part of an uplight module.

Subassemblies 204*a*, 204*b* with a diffuser 209*a*, 209*b* may also comprise a side cap 212*a*, 212*b*. Side cap includes an opening 213 that assists in cooling the area within the subassembly 204*a* or 204*b*, while limiting the amount of dust that can enter the diffuser. Side cap may comprise aluminum or a plastic material, such as a clear plastic for further diffusing light.

Figure 3:
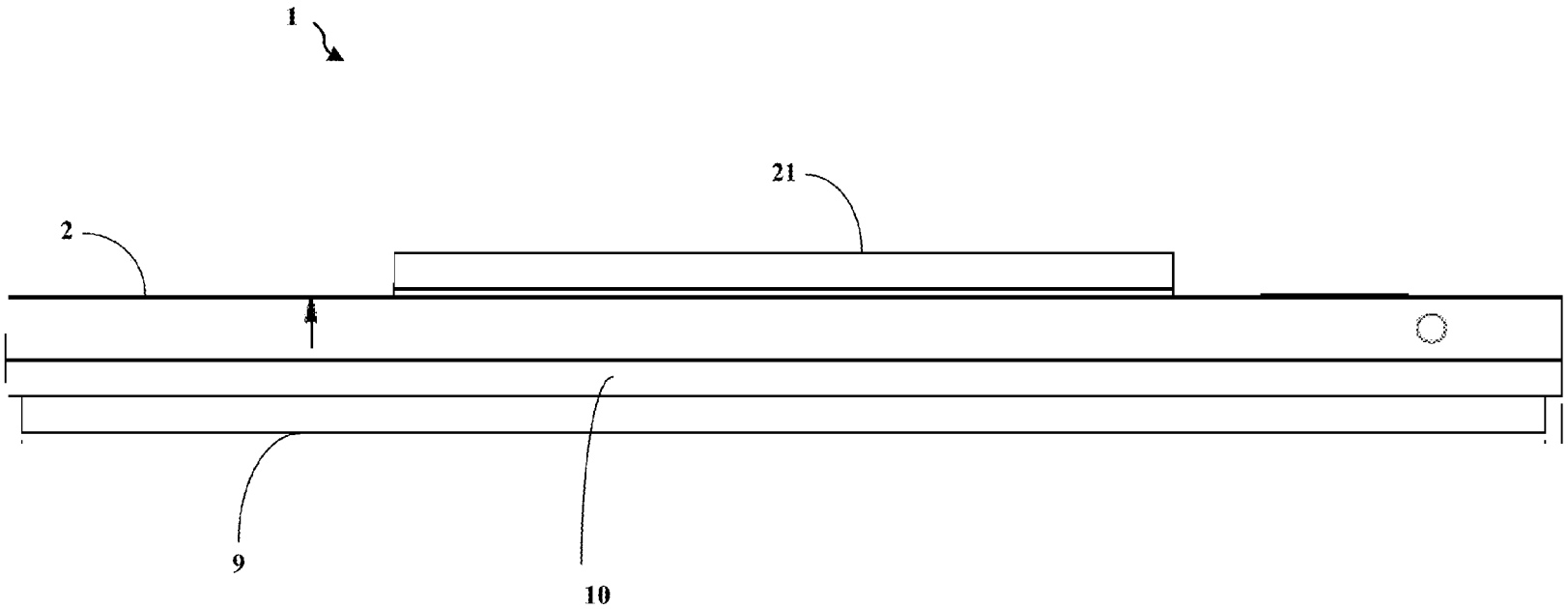
FIG. 3 shows a side view of an example light emitting apparatus having aspects in accordance with the present invention.

FIG. 3 illustrates a side view of the light emitting apparatus 1. In FIG. 3, the diffuser 9*a* is illustrated as extending beyond the side portion 10 extending from the housing 2.

Reflector

Figure 4:
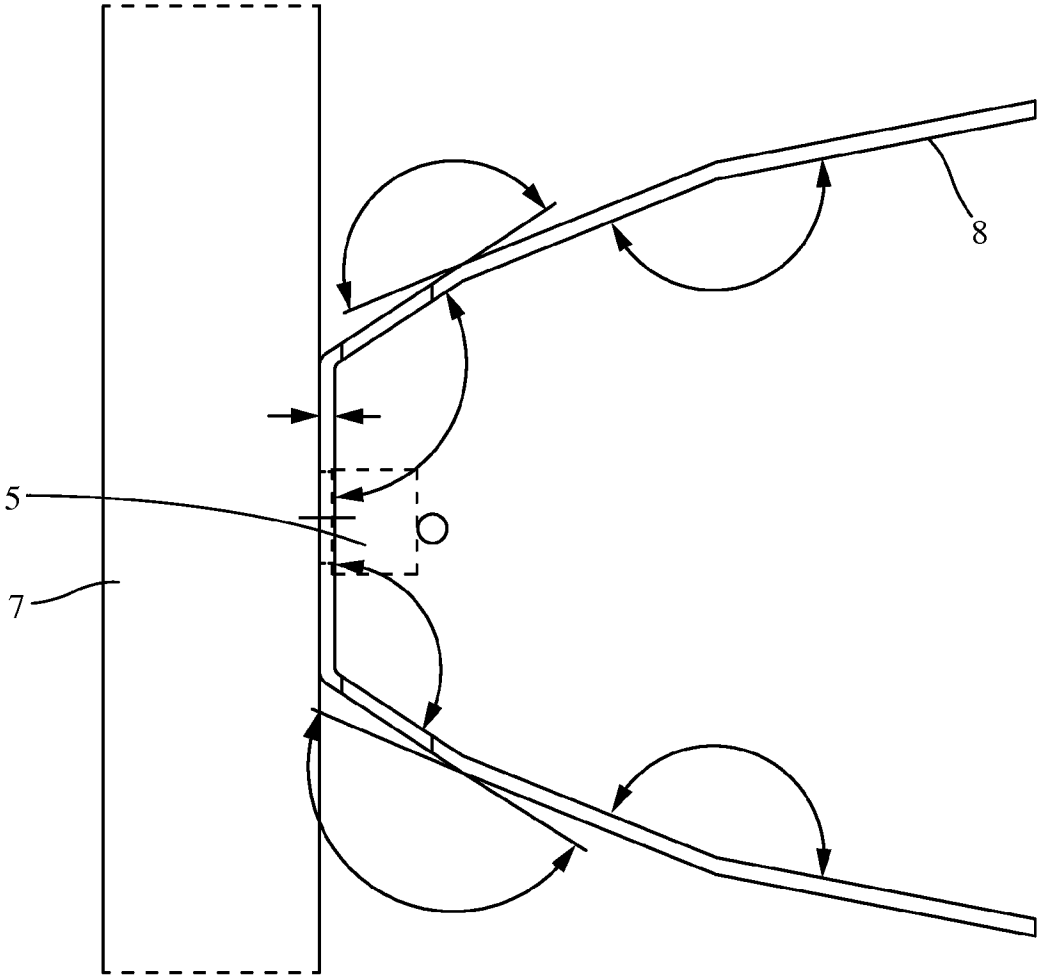
FIG. 4 shows side view of an example reflector having aspects in accordance with aspects of the present invention.

Various reflector designs may be used. The reflector may be rolled, having a continuous curve. In another variation, the reflector may include a plurality of angles and facets. An example of this variation is shown in FIG. 4, which illustrates one example of a faceted reflector. As illustrated, the reflector may comprise a plurality of facets on each side of the reflector. In FIG. 4, the reflector comprises three facets on each reflector side. As illustrated in FIG. 4, the reflector 8 may be coupled between the LED strip 5 and the mounting component 7.

Figure 7:
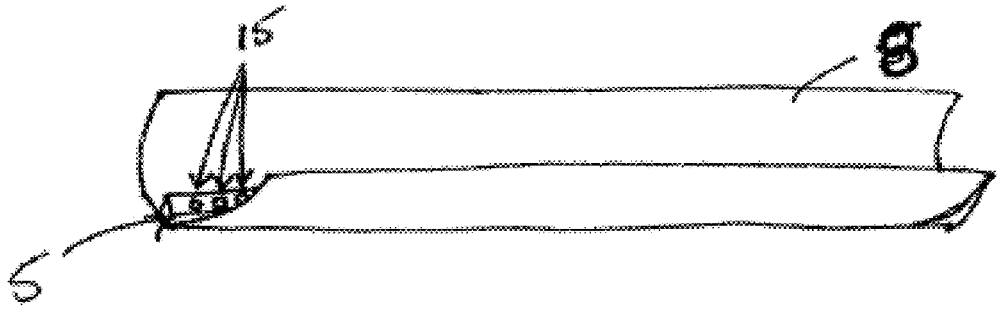
FIG. 7 shows a view of a reflector and light emitting strip having aspects in accordance with the present invention.

FIG. 7 illustrates an LED strip 5 having a linear arrangement of LEDs 15 that extends linearly along with the reflector 8.

The reflectors may improve the intensity and direction of dispersion of light emitting from the LED strips positioned within the reflectors by directing it to a desired area to maximize horizontal foot candles.

The reflector in any of the variations discussed herein need not be completely reflective. For example, an aluminum material without any further reflective layer may be used. Any suitably reflective material or material with an added reflective layer may also be used. For example, the reflector may be made of aluminum with an added layer. In addition, aluminum with a silver coating may be used. The materials are not limited to aluminum or other metals, but may also include plastics and other similar materials with a polished or chrome finish, or other reflective surfaces. In addition, partially transparent and partially reflective materials may be used. Any suitably reflective material may be used for the reflectors.

Additional aspects of an LED light fixture using reflectors, heat sink, and control aspects are described in U.S. application Ser. No. 13/462,674, titled "LED LAMP APPARATUS AND METHOD OF MAKING AN LED LAMP APPARATUS", filed on May 2, 2012, Published as Publication No. 2012/0307483, which is a Continuation of U.S. application Ser. No. 12/243,316, filed Oct. 1, 2008, issued as U.S. Pat. No. 8,186,855, which claims priority to U.S. Provisional Patent Appl. No. 61/071,828 filed May 20, 2008 and U.S. Provisional Patent Appl. No. 60/960,473 filed Oct. 1, 2007; and U.S. application Ser. No. 13/692,402 titled "LIGHTING FIXTURE" filed on Dec. 3, 2013, Published as Publication No. 2013/0155675, which claims priority to U.S. application Ser. No. 12/341,798 filed on Dec. 22, 2008, now U.S. Pat. No. 8,322,881, which claims priority to Provisional Application No. 61/015,713 filed on Dec. 21, 2007 and Provisional Application No. 61/094,558 filed on Sep. 5, 2008, the entire contents of each of which are hereby expressly incorporated by reference herein in their entirety. These aspects may be incorporated into the light emitting apparatus described herein.

The illumination direction 11 is the direction in which light is directed from the subassemblies 3*a*, 3*b*, 4*a*, 4*b*.

Mounting Component/Heat Sink

Although solid state light emitting elements, such as LEDs, may be more efficient that conventional lighting sources, heat is still generated under operating conditions, which may degrade device performance and/or reliability of the lighting fixture. This heat energy has to be dissipated. If this heat energy is not effectively removed, the high temperature caused by the heat energy will reduce the luminance and life span of the LEDs. Therefore, each of the foregoing-described light emitting subassemblies may include a heat dissipating mechanism to adequately remove the heat energy produced by the large number of LEDs.

The mounting component of each subassembly may be configured to provide heat extrusion from the LEDs. The mounting component may comprise, e.g., aluminum. This unique, light weight extrusion design may integrate a special channel for the LED strips, e.g., having a center opening that enables the LED strips to be secured thereto, e.g., with screws, without requiring special tooling of the mounting substrate/heat sink to drill holes in specific positions for screwing down the LED strips. This also enables LED strips to be changed, if necessary, without having to modify the mounting substrate. The mounting substrate may also include channels on each side of the center channel for the LED strips so that the diffuser can be mounted into those slots/channels and be held there with a minimum number of screws or fasteners. This will also allow for the replacement/repair of the diffuser material if it should ever become damaged.

Figure 8A:
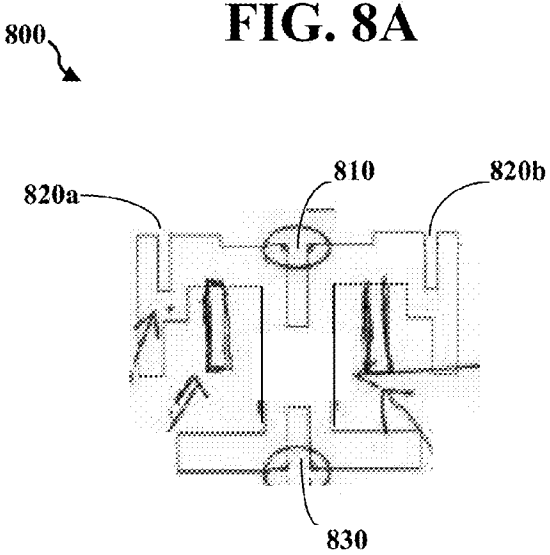
FIGS. 8A and 8B show a cross section and a side view of a mounting component having aspects in accordance with the present invention.
Figure 8B:
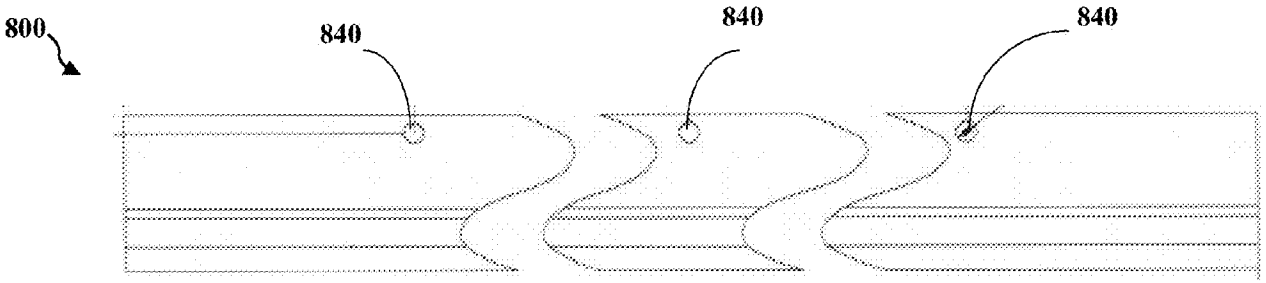

FIG. 8A illustrates a cross section of an example mounting component 800. The mounting component 800 extends along the length of the subassembly. The mounting component 800 comprises a central channel 810 configured to enable the LED strips to be secured to the mounting component. This channel may be configured to receive wiring and other components of the LED strips. A channel 830 opposite the central channel 810 enables the mounting component 800 to be secured to the housing 2, e.g., by screws or other attachments. On either side of the center channel 810, additional channels 820*a*, 820*b* can be provided. These side channels 820*a*, 820*b* can be configured to receive and secure the diffuser. FIG. 8B illustrates a side view of the mounting component 800. Along the side at a position along the side channels 820*a*, 820*b*, openings 840 may be provided to secure the diffuser material into channels 820*a*, 820*b*. The diffuser may be secured, e.g., using screws or another type of attachment. The channels 801, 802, and 803 simplify construction and repair of the light emitting apparatus 1.

The mounting component 7*a-d*,207*a-d*, 22, 800 not only receives the diffuser and LED strips to enable mounting to the housing 2 in a user friendly manner, but the mounting component provides a heat sink to cool the LEDs. The use of aluminum both provides a lightweight component and one that is able to diffuse heat from the LEDS.

As the mounting component can function as a heat extrusion component that provides very efficient heat dissipation, the housing does not need to dissipate heat generated by the LEDs. This increases the potential materials that can be selected for the housing. For example, the housing can comprise plastic and other such materials. The ability to use plastic and other less expensive materials for the housing allows a reduction in the cost of manufacturing the shell. This cost reduction allows the light emitting apparatus to be made available at a lower cost to customers.

Diffuser Material

The diffuser may comprise a flexible, resilient diffusing material. The diffusing material may be selected to efficiently pass light from the LEDs and allow for a high level of efficacy. This also enables the LED light fixture to be as energy efficient as possible. The diffuser may comprise a sheet of flexible, diffusing material that can be bent and coupled to a mounting substrate on which the LEDs are provided. This material may also be selected so that it can be machined to attach to the mounting substrate, e.g., by sizing the diffusing material to slide into grooves on the mounting substrate/heat sink and by adding openings to allow the diffuser to be secured to the mounting substrate/heat sink. The two elements may be secured by bolting, clamping, screwing, or otherwise securing the two elements together.

Attempts have been made to diffuse light from LEDs, e.g., by providing a frosted tube around the LEDs, similar to a fluorescent tube. However, these diffusers are usually sealed and without proper heat dissipation can trap too much heat and reduce the lifetime of the light fixture. Or, all of the LEDs may be covered with a flat or semi curved diffuser. This may allow for light to be diffused but does not allow for the type of combined refraction and diffusing of light as offered by the diffuser, e.g., 4*a*, 4*b*, described herein. By providing a diffuser that couples to a mounting substrate functioning as a heat sink not only simplifies the manufacturing process, but also maintains the light fixture at a cooler temperature than other diffusers, which significantly increases the lifetime of the light fixture, while allowing light to be diffused at angles as high as approximately 150 degrees. Additionally, the simplified design, which allows the diffuser to be folded, placed into slots in the mounting substrate, and secured, e.g., with a couple of screws, enables quick and easy replacement of damaged diffusers even in the field.

The diffusing material may comprise, e.g., a high performance, symmetric LED diffuser that hides the LEDs, provides significant angle of smooth illumination, and provides for angle management. The diffusing material may be selected, e.g., to provide at least 85%, and preferably more than 88% and more preferably more than 90% efficiency in LED light. The diffusing material may be selected, e.g., to provide at least 95% AST D1003 transmission. And to provide a typical angle in a 90 degree downlight of approximately 70 degrees for microstructures facing away from lamps and approximately 115 degrees for microstructures facing toward lamps. For example, one example of a diffuser material is C-HE80 provided by BrightView Technologies, information for which can be found at the BrightView Technologies website, e.g., at http://www.brightviewtechnologies.com/products/led-diffusers/symmetric-led-diffusers/page.aspx?id=1120.

Uptight Module

LEDs are designed to emit light that is direction specific in nature, and as such can add to their efficiency. The downside to this directionality makes it difficult to emit light 360 degrees, as can be done with traditional light sources such as bulbs, or to be emitted from the same fixture into space above the fixture. Aspects of this design may further include the provision of an uplight module, e.g., 20, that provides light above the light fixture 1. This may be especially beneficial in light fixtures mounted near a ceiling in a large building, warehouse, or other commercial facility. The uplight module bathes the area above the light fixture in light, providing a visual aesthetic similar to high discharge or fluorescent type lamps with housings designed to allow for uplight, and to utilize some of the 360 degree nature of bulbs. This upper illumination brightens the warehouse and provides a visual effect so that the entire warehouse, including the ceiling appears bright and open. This allows potential customers and other persons to be aware that the building is open and lit even from a distance.

The uplight module 20 may comprise a single or plurality of LEDs 21 coupled to the housing 2 via a mounting component 22. The LEDs 21 and the mounting component 22 may be similar to or the same as those provided for the subassemblies of the light fixture, including the heat sink aspects. The uplight module may comprise fewer LEDs than any one of the subassemblies, as less light is typically required for the uplight module.

Figure 5:
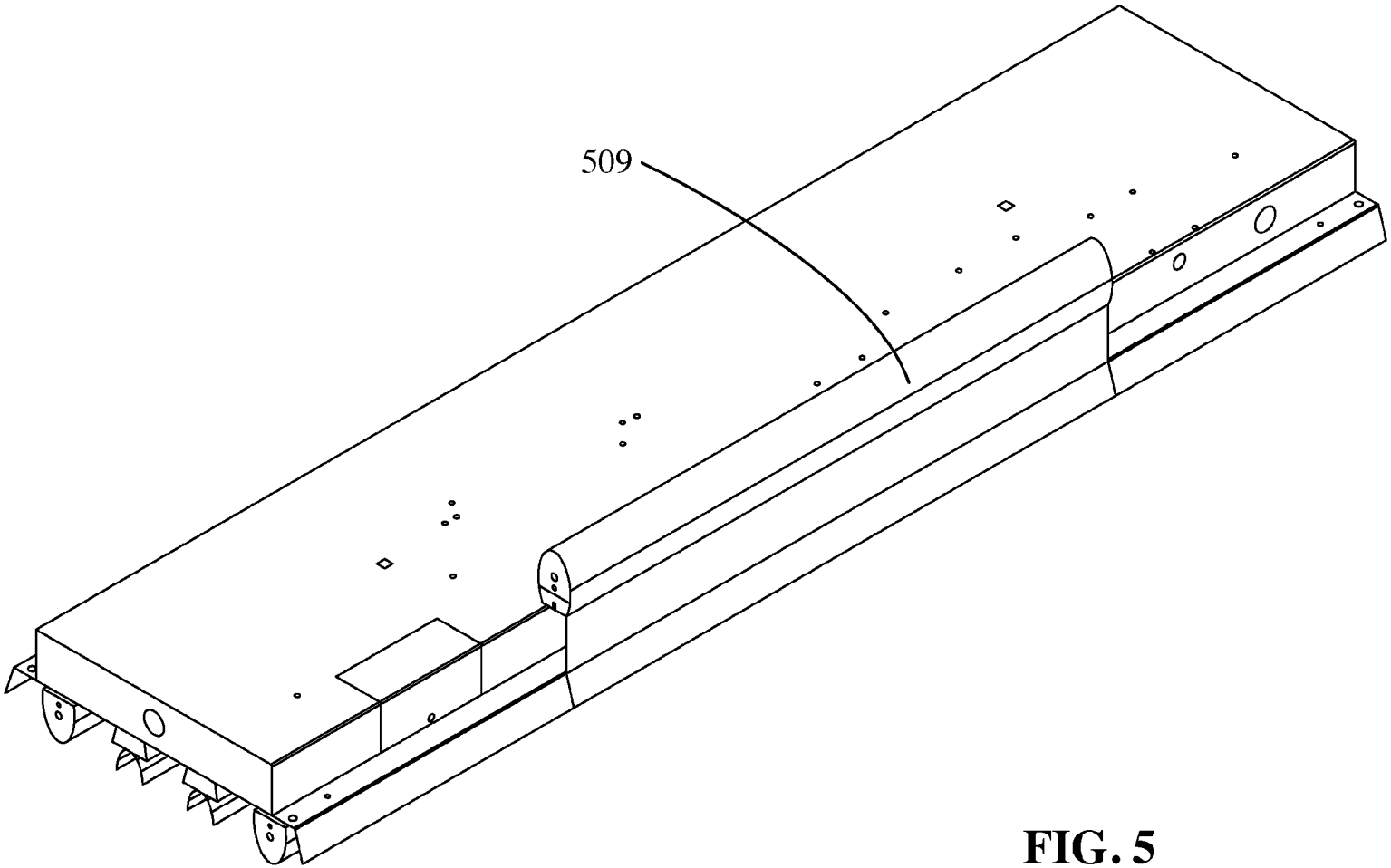
FIG. 5 shows an upper view of an example light emitting apparatus having aspects in accordance with the present invention.
Figure 6:
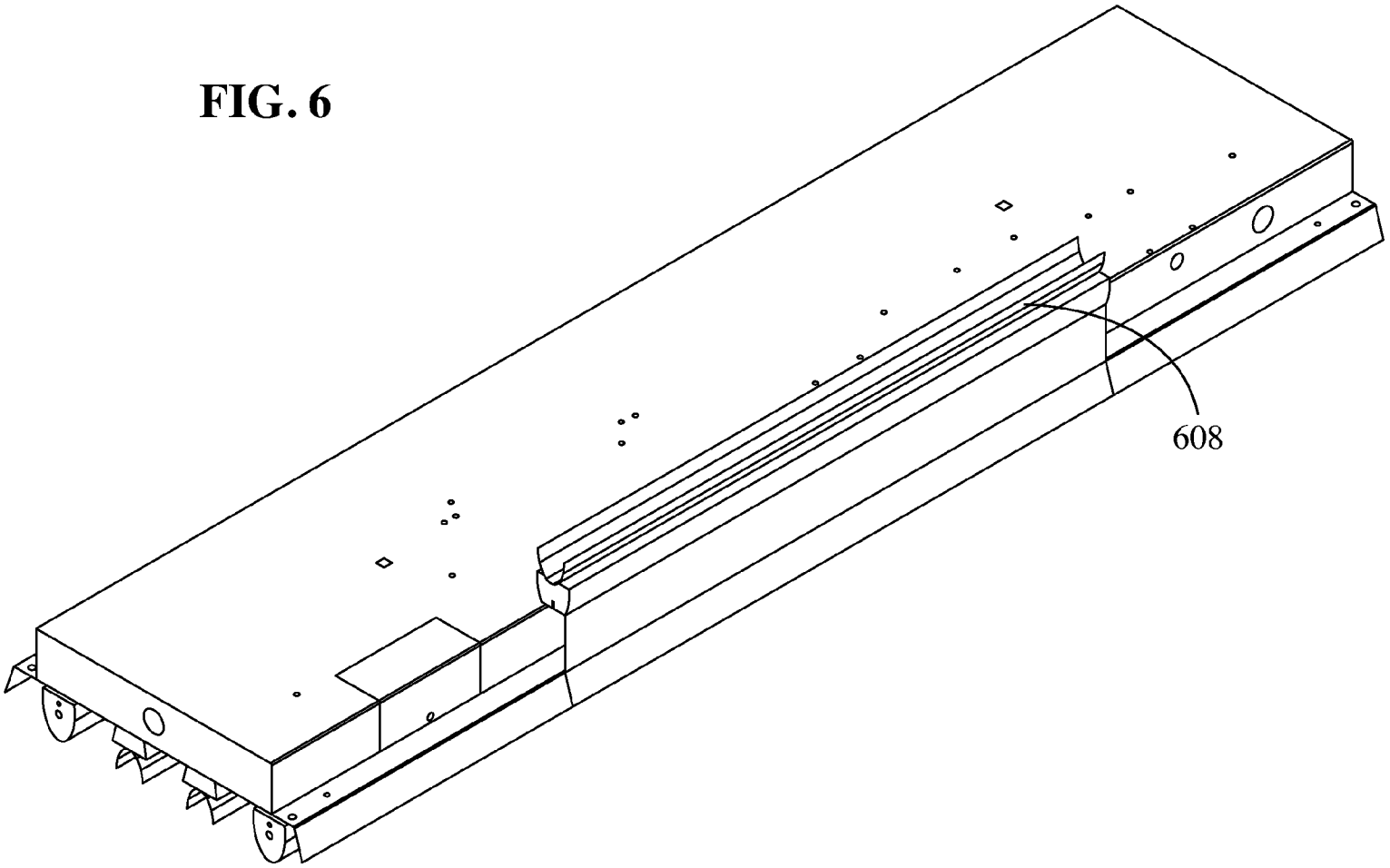
FIG. 6 shows an upper view of an example light emitting apparatus having aspects in accordance with the present invention.

The uplight module may comprise a reflector to direct the light. FIG. 6 illustrates the uplight module comprising a reflector 608. The uplight module may comprise a diffuser. The diffuser may be similar to that provided for the subassemblies. FIG. 5 illustrates an uplight module having a diffuser 509 provided over the LEDs. The use of a reflector, a diffuser, or the absence of such may be selected, e.g., based on the distance at which the light fixture will be mounted from a ceiling. For example, a diffuser may be provided over the LEDs in the uplight module when it will be placed a distance of less than approximately 10 feet, e.g., especially within 4 feet from a ceiling. For example, when the light fixture will be mounted approximately 1-4 feet from the ceiling, the diffuser may be important in order to properly bathe the area above the fixture with light. Without such uplight a facility can have the look of being dark, even if significant light is being projected down to the lower surface areas. In areas where there are higher ceiling distances from the floor, and where the lights are mounted at distances from the ceiling of greater than 4 feet, and where the reflectivity from the floor surfaces back to the ceiling is not sufficient to light up the ceiling, use of reflectors on the uplight module can have a significant positive impact to how the area is perceived as adequately bathed by the viewer.

Control System

A power supply and a control circuitry may be provided, e.g., within the housing 2, side housing 1003, or at another location. The power supply and control circuitry are electrically coupled to each of the plurality of LED light strips, e.g., via wiring, to provide effective lighting control.

The light fixture may further include a control system physically integrated into the light. The control system may be configured, e.g., to provide energy harvesting or occupancy lighting. For example, the control system may be used to automatically dim the light fixture or turn it off when sufficient light is provided from another source. For example, during bright daytime hours, the control system may automatically dim the light emitted from the light source. If the light drops, e.g., due to weather or as the sun goes down, the control system may automatically increase the amount of light provided by the light fixture so that a sufficient amount of light is provided.

The control system may further include smart monitoring and remote control of the light fixtures. Additional control aspects are described in U.S. patent application Ser. No. 13/588,926, titled, "Lighting Device Monitor and Communication Apparatus," filed on Aug. 17, 2012, which claims priority to Provisional Application No. 61/525,448 titled "Lighting Device Communication Apparatus" filed Aug. 19, 2011, and Provisional Application No. 61/542,556, titled Lighting Device Including Power Supply and Surge Protection Monitoring, filed Oct. 3, 2011; and U.S. application Ser. No. 13/692,402 titled "LIGHTING FIXTURE" filed on Dec. 3, 2013, Published as Publication No. 2013/0155675, which claims priority to U.S. application Ser. No. 12/341,798 filed on Dec. 22, 2008, now U.S. Pat. No. 8,322,881, which claims priority to Provisional Application No. 61/015,713 filed on Dec. 21, 2007 and Provisional Application No. 61/094,558 filed on Sep. 5, 2008, the entire contents of each of which are hereby expressly incorporated by reference herein.

Reduced Housing

Figure 10:
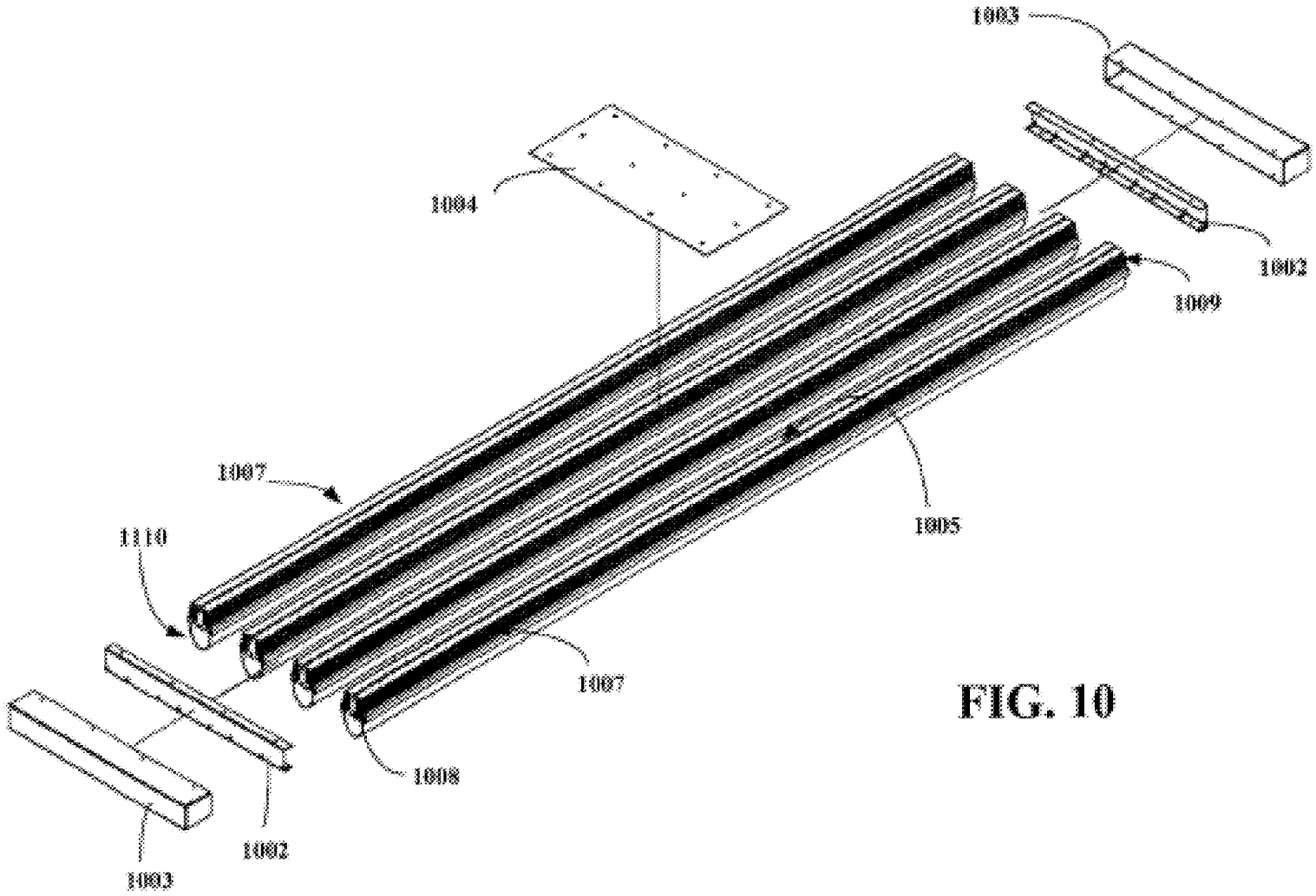
FIG. 10 illustrates a lighting fixture having a modified housing in accordance with aspects of the present invention.

FIG. 10 illustrates example aspects of a lighting fixture having a reduced housing. Whereas, in FIGS. 1A and 1B, the mounting component 7*a-d* connects between the LED strips 5*a-d* and the housing, FIG. 10 illustrates alternative aspects in which each of the mounting components 1007 are coupled at each end, e.g., 1008 and 1009 to a side piece 1002. For example, a screw or other attachment may hold each mounting component 1007 to the side piece 1002. A side housing 1003 fits over each side piece 1002. Power supply and control circuitry that connects to each LED lighting strip along the length of the mounting components 1007 may be provided within a side housing 1003. The side housing 1003 may be sized in order to accommodate the desired power supply and control circuitry.

Although connecting the mounting component 1007 to each of the side pieces 1002 holds the mounting component in a fixed position in the lighting fixture, the lighting fixture may optionally include an additional stabilizer piece 1004 that couples to each of the mounting components 1007 on a surface 1005 opposite the surface on which the LED lighting strips are provided.

Although four mounting components are illustrated, the lighting fixture may comprise any number of mounting components and lighting strips. For example, the lighting fixture may comprise 2, 3, 4, etc. subassemblies, each subassembly having a mounting component and an attached row of LED lighting strips.

Likewise, each of the mounting components may comprise either a reflector or a diffuser. Although FIG. 10 illustrates a diffuser 1110 connected to each mounting component 1007, aspects of the reduced housing may be used in a lighting fixture having a reflector for the inboard subassemblies rather than the illustrated diffuser 1110, similar to the 3*a* and 3*b* in FIGS. 1A and 1B. Thus, each of the subassemblies may comprise a diffuser, as illustrated in FIG. 10, each of the subassemblies may comprise a reflector, e.g., as illustrated in connection with 3*a* and 3*b* in FIGS. 1A and 1B, and the subassemblies may comprise any combination of diffusers and reflectors. The type and number of subassemblies may be selected based on the intended application for the lighting fixture.

Figure 11:
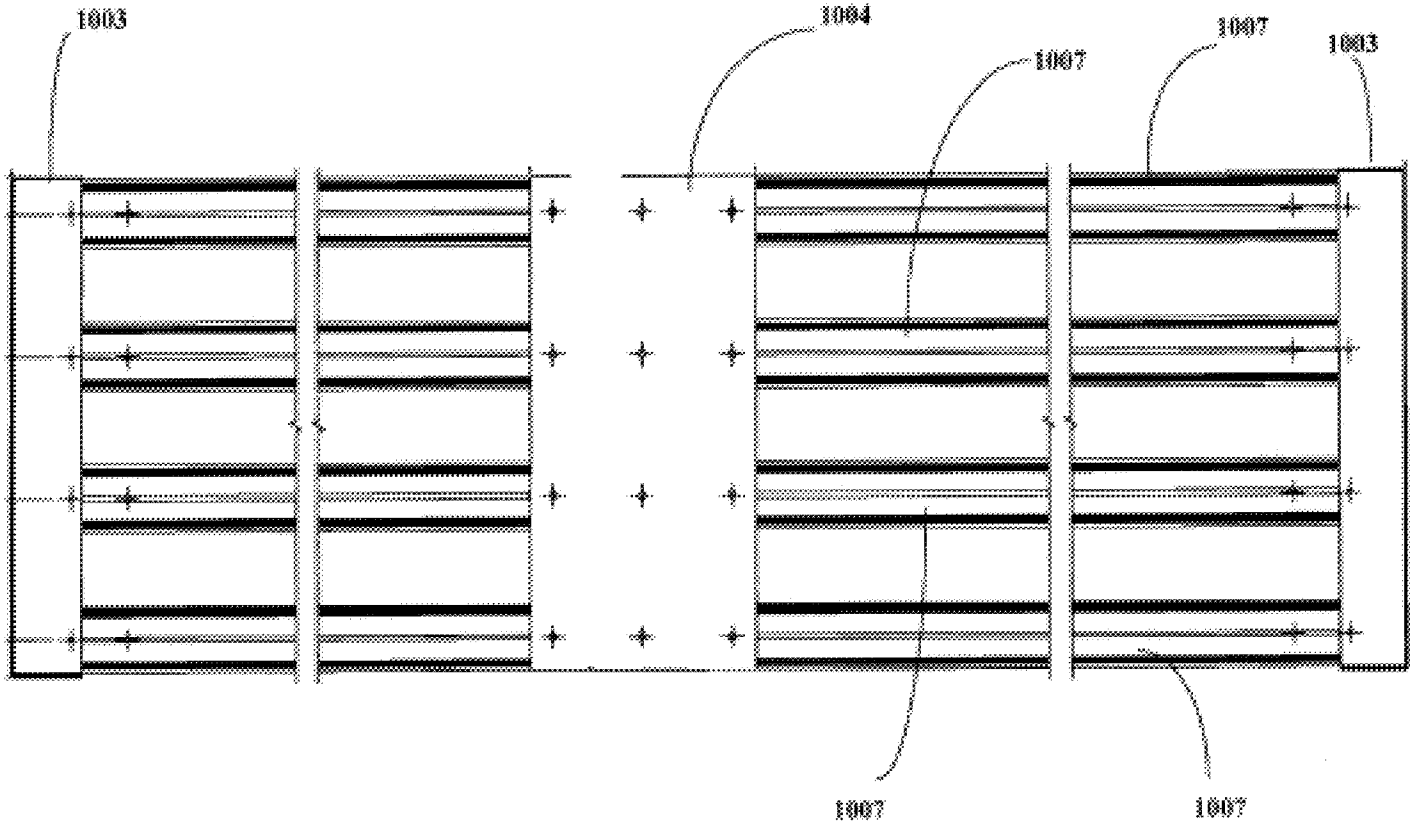
FIG. 11 illustrates a lighting fixture having a modified housing in accordance with aspects of the present invention.
Figure 12:
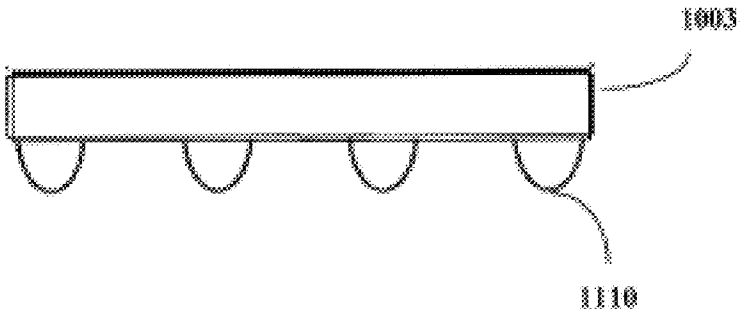
FIG. 12 illustrates a lighting fixture having a modified housing in accordance with aspects of the present invention.
Figure 13:
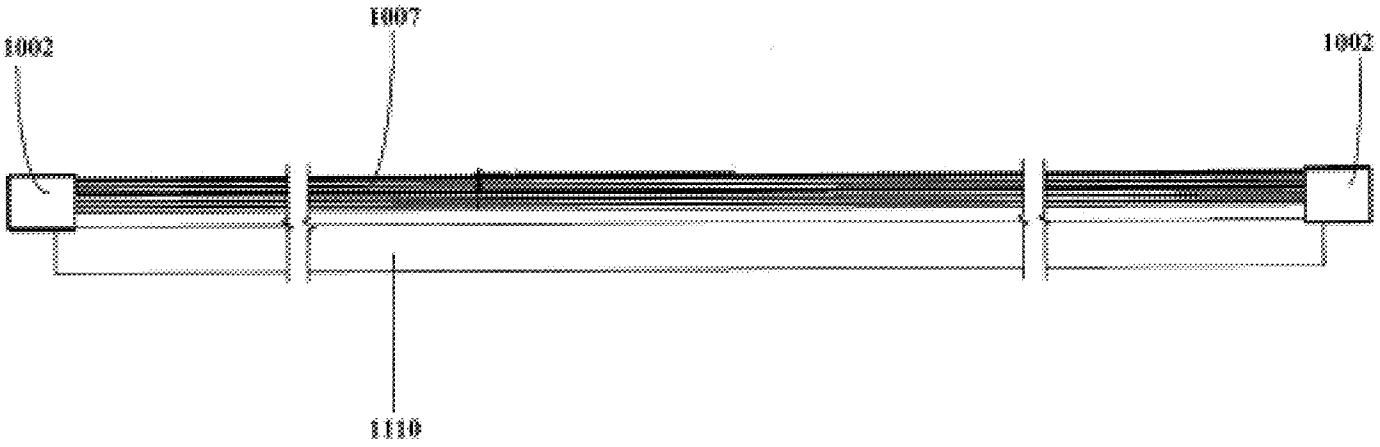
FIG. 13 illustrates a lighting fixture having a modified housing in accordance with aspects of the present invention.

FIG. 11 illustrates an assembled view of the lighting fixture in FIG. 10 from above, i.e., from the side opposite the light emission side. FIG. 12 illustrates an assembled view of the lighting fixture in FIG. 10 from a side end. FIG. 13 illustrates an assembled view of the lighting fixture in FIG. 10 from a side view along the length of the light fixture.

Although the illustrated examples show a rectangular shaped apparatus, a circular or other shaped apparatus may also be used.

Example aspects of the present invention have now been described in accordance with the above advantages. It will be appreciated that these examples are merely illustrative thereof. Many variations and modifications will be apparent to those skilled in the art.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects." Unless specifically stated otherwise, the term "some" refers to one or more. Combinations such as "at least one of A, B, or C," "at least one of A, B, and C," and "A, B, C, or any combination thereof" include any combination of A, B, and/or C, and may include multiples of A, multiples of B, or multiples of C. Specifically, combinations such as "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

The invention claimed is:

1. A light emitting apparatus for mounting at a ceiling, comprising:

a luminaire housing configured for mounting to a ceiling;

a plurality of light emitting subassemblies coupled to the luminaire housing, each subassembly comprising a plurality of LEDs, wherein a first plurality of the light emitting subassemblies each comprise an individual diffuser extending a length of the corresponding subassembly and positioned in front of a light emitting side of the plurality of LEDs on the first plurality of subassemblies, the individual diffuser configured to bathe an area surrounding the light light emitting apparatus with diffuse light wherein a subassembly comprising the diffuser is positioned on each side of the luminaire housing, and wherein a second plurality of the light emitting subassemblies each comprise a reflector reflecting light emitted from the plurality of LEDs without a diffuser cover, wherein the reflector is positioned between the first plurality of light emitting subassemblies with the diffuser and the reflector extends along a length of the corresponding subassembly at an angle wherein the reflector is configured to direct light to a ground level of a warehouse and to a lower rack area of the warehouse and each diffuser is configured to diffuse light to an upper rack area of the warehouse.

2. The apparatus of claim 1, wherein each of the light emitting subassemblies comprises a mounting component that couples the plurality of LEDs to the luminaire housing, wherein the mounting component forms a heat sink for dissipating heat emitted by the LEDs.

3. The apparatus of claim 1, further comprising:

a housing; and an uplight module coupled to the housing on a side opposite the light emitting subassemblies.

4. The apparatus of claim 1, further comprising:

a housing coupled to the plurality of subassemblies, wherein the housing extends along the length of the subassemblies.

5. The apparatus of claim 1, further comprising:

a side piece coupled to an end of the plurality of subassemblies; and a side housing surrounding at least a portion of the side piece.

6. The light emitting apparatus of claim 1, further comprising:

a side piece coupled in common to each of the plurality of subassemblies, wherein the side piece is coupled to each subassembly at a side portion and holds the subassemblies in a fixed position relative to each other with a spacing between each of the adjacent subassemblies to form an opening that extends through the light emitting apparatus between the adjacent subassemblies; and a stabilizer piece coupled to an intermediate portion of each of the plurality of subassemblies, wherein the stabilizer piece extends for only a first portion of the length of the subassemblies and the remaining portion of the length of the subassemblies comprises the opening that extends through the light emitting apparatus between the adjacent subassemblies.

7. The apparatus of claim 1, wherein each subassembly comprises a rectangular mounting component with the plurality of LEDs for the subassembly extending along a length of the mounting component.

8. The apparatus of claim 1, wherein each of the plurality of subassemblies comprises either the diffuser or the reflector.

9. The apparatus of claim 2, wherein the mounting component comprises a plurality of channels, wherein the channels are configured to receive at least one selected from a group consisting of an LED light strip having a reflector, an LED light strip without a reflector, and the diffuser.

10. The apparatus of claim 2, wherein the reflector is secured to the mounting component of the LED strip.

11. The apparatus of claim 9, wherein the diffuser comprises a flexible diffusing material that bends such that edges of the diffuser are received in the channels of the mounting component.

12. The apparatus of claim 3, wherein the uplight module comprises at least one of a diffuser and a reflector.

13. The apparatus of claim 5, further comprising:

a power supply and control circuitry disposed inside the side housing.

14. The apparatus of claim 5, further comprising:

two side pieces coupled to each of the plurality of subassemblies at opposite ends; and two side housings, each surrounding at least a portion of one of the side pieces, wherein a power supply and control circuitry are disposed inside at least one side housing.

15. The apparatus of claim 6, further comprising:

a side housing surrounding at least a portion of the side piece.

16. The apparatus of claim 6, wherein the first portion is smaller than the remaining portion.

17. The apparatus of claim 15, further comprising:

a power supply and control circuitry disposed inside the side housing.

18. The apparatus of claim 15, further comprising:

two side pieces, one side piece being coupled to each of the plurality of subassemblies at a first end and the other side piece being coupled to each of the plurality of subassemblies at an end opposite the first end; and two side housings, wherein each side housing surrounds at least a portion of one of the side pieces, wherein a power supply and control circuitry are disposed inside at least one side housing.

19. The apparatus of claim 7, wherein the diffuser comprises a cover that extends along the length of the corresponding mounting component and is configured to diffuse light in common from the plurality of LEDs on the corresponding mounting component.

* * * * *